US012661700B2

(12) United States Patent
Tsuruta et al.

(10) Patent No.: US 12,661,700 B2
(45) Date of Patent: Jun. 23, 2026

(54) ROLL PRESS MACHINE

(71) Applicant: Hitachi Power Solutions Co., Ltd., Hitachi (JP)

(72) Inventors: Sadao Tsuruta, Hitachi (JP); Daisuke Tasaki, Hitachi (JP); Shun Ito, Hitachi (JP); Masanori Takahashi, Hitachi (JP); Takahiro Mitamura, Hitachi (JP)

(73) Assignee: HITACHI POWER SOLUTIONS CO., LTD., Hitachi (JP)

( * ) Notice: Subject to any disclaimer, the term of this patent is extended or adjusted under 35 U.S.C. 154(b) by 249 days.

(21) Appl. No.: 18/225,194

(22) Filed: Jul. 24, 2023

(65) Prior Publication Data

US 2024/0051004 A1 Feb. 15, 2024

(30) Foreign Application Priority Data

Aug. 10, 2022 (JP) ..... 2022-127641

(51) Int. Cl.
*B21B 37/68* (2006.01)
*B21B 13/14* (2006.01)
(Continued)

(52) U.S. Cl.
CPC ..... *B21B 37/68* (2013.01); *B21B 13/14* (2013.01); *B21B 29/00* (2013.01); *B21B 31/32* (2013.01); *B21B 37/38* (2013.01)

(58) Field of Classification Search
CPC ..... B21B 37/68; B21B 37/38; B21B 13/14; B21B 29/00; B21B 31/32
See application file for complete search history.

(56) References Cited

U.S. PATENT DOCUMENTS 2,825,217 A 3/1958 Byrd
3,364,715 A 1/1968 Wagner
(Continued)

FOREIGN PATENT DOCUMENTS

JP 2012-143790 A 8/2012
JP 5097863 B1 12/2012
JP 2013-111647 A 6/2013

OTHER PUBLICATIONS

Extended European Search Report received in corresponding European Application No. 23188357.0 dated Feb. 21, 2024.

*Primary Examiner* — Mohammed S. Alawadi
(74) *Attorney, Agent, or Firm* — MATTINGLY & MALUR, PC

(57) ABSTRACT

A roll press rolls each including an upper roll and a lower roll that are supported by a main bearing at both ends and rotate at a predetermined speed, upper and lower bending bearings that are disposed outside each of the main bearings and correct deflection of the press rolls by receiving a bending load, an upper reverse operation bending mechanism provided in the upper roll that operates with hydraulic oil, a lower reverse operation bending mechanism provided in the lower roll, and two upper reverse operation bending mechanisms and two lower reverse operation bending mechanisms being installed in the upper and lower bending bearings, respectively. Deflection occurring in the upper roll and the lower roll is corrected by causing the upper reverse operation bending mechanism or the lower reverse operation bending mechanism to generate downward power or upward power, respectively.

14 Claims, 7 Drawing Sheets

(51) Int. Cl.

| | |
|---|---|
| ***B21B 29/00*** | (2006.01) |
| ***B21B 31/32*** | (2006.01) |
| ***B21B 37/38*** | (2006.01) |
| ***B29C 43/24*** | (2006.01) |
| ***B29C 43/46*** | (2006.01) |
| ***B30B 3/00*** | (2006.01) |
| ***B30B 3/04*** | (2006.01) |
| ***H01M 4/04*** | (2006.01) |
| ***H01M 10/0525*** | (2010.01) |

(56) References Cited

U.S. PATENT DOCUMENTS

| | | | | | |
|---|---|---|---|---|---|
| 3,507,138 | A | | 4/1970 | Neuber | |
| 3,610,013 | A | * | 10/1971 | Pillon | B21B 31/10 72/245 |
| 3,744,278 | A | | 7/1973 | Richter | |
| 4,364,158 | A | | 12/1982 | Bainton | |
| 5,809,821 | A | | 9/1998 | Figge | |
| 2023/0046202 | A1 | * | 2/2023 | Terasawa | H01M 10/04 |

* cited by examiner

→ : FLOW OF HYDRAULIC OIL (6a)

→ : FLOW OF HYDRAULIC OIL (6a)

ROLL PRESS MACHINE

CLAIM OF PRIORITY

The present application claims priority from Japanese Patent application serial no. 2022-127641, filed on Aug. 10, 2022, the content of which is hereby incorporated by reference into this application.

BACKGROUND OF THE INVENTION

1. Field of the Invention

The present invention relates to a roll press machine, and for example, relates to a roll press machine suitable for compressing-processing a thin film material such as an electrode material for a secondary battery such as a lithium ion battery.

2. Description of the Related Art

It is known that, when a thin film material such as an electrode material for a lithium ion secondary battery is subjected to compression processing by using a roll press machine, concave deflection occurs in a roll due to a reaction force received from a compression material.

In general, the electrode material for a lithium ion secondary battery is required to have an error in compression processing of about ±1 to 2 μm, but the above-described concave deflection occurring in the roll affects the error in compression processing.

Thus, it is necessary to correct the above-described concave deflection occurring in the roll. For example, JP 5097863 B discloses a roll press machine including a bending mechanism that corrects the deflection of the roll by applying a load to the roll in a direction opposite to the deflection of the roll, which occurs due to a processing load of the material, with a bending bearing installed outside the main bearing.

The bending mechanism of the roll press machine disclosed in JP 5097863 B includes a cylinder unit and a piston inside the cylinder unit, and the piston is configured to be connected to a bending bearing by a piston rod. When hydraulic oil is supplied to the inside of the cylinder unit, the piston and the piston rod are operated, and thus the bending bearing moves. A load due to a bending load is applied to the roll, and, in this manner, the concave deflection is corrected.

SUMMARY OF THE INVENTION

In the roll press machine disclosed in JP 5097863 B described above, the operating direction of the piston and the piston rod operated by the cylinder is the same as the direction in which the bending bearing moves. Conventionally, since the hydraulic oil is supplied from the piston rod side to the inside of the cylinder, the piston and the piston rod move to the head side of the piston.

Therefore, the cylinder accommodating the piston needs to secure a space for moving the piston to the piston head side. However, in a case where it is necessary to press a material with higher linear pressure than the conventional case, the deflection amount of the roll increases accordingly. Thus, in order to perform deflection correction, it is necessary to increase the bending load applied to the bending bearing.

However, in order to increase the bending load, it is necessary to increase the size of the cylinder. Thus, a problem that a machine housing in which the cylinder is disposed also increases in size, which leads to an increase in the cost of the entire machine occurs.

The present invention has been made in view of the above points, and an object of the present invention is to provide a roll press machine that does not increase in size and does not lead to an increase in cost even if the roll press machine includes a bending mechanism that corrects the deflection of a roll.

In order to achieve the above object, according to the present invention, there is provided a roll press machine that compression-processes a thin film material, the roll press machine including a pair of upper and lower press rolls each including an upper roll and a lower roll that are supported by a main bearing at both ends and rotate at a predetermined speed, upper and lower bending bearings that are disposed outside each of the main bearings and correct deflection of the press rolls by receiving a bending load, and an upper reverse operation bending mechanism provided in the upper roll that operates with hydraulic oil, and a lower reverse operation bending mechanism provided in the lower roll, two upper reverse operation bending mechanisms and two lower reverse operation bending mechanisms being installed in the upper and lower bending bearings, respectively. Deflection occurring in the upper roll and the lower roll is corrected in a manner that a bending load that moves upward the upper bending bearing disposed on the upper roll is applied by causing the upper reverse operation bending mechanism to generate downward power by hydraulic pressure of the hydraulic oil, and a bending load that moves downward the lower bending bearing disposed on the lower roll is applied by causing the lower reverse operation bending mechanism to generate upward power by the hydraulic pressure of the hydraulic oil.

According to the present invention, even if the bending mechanism that corrects the deflection of the roll is provided, the machine does not increase in size and does not lead to an increase in cost.

DESCRIPTION OF THE PREFERRED EMBODIMENTS

Figure 1:
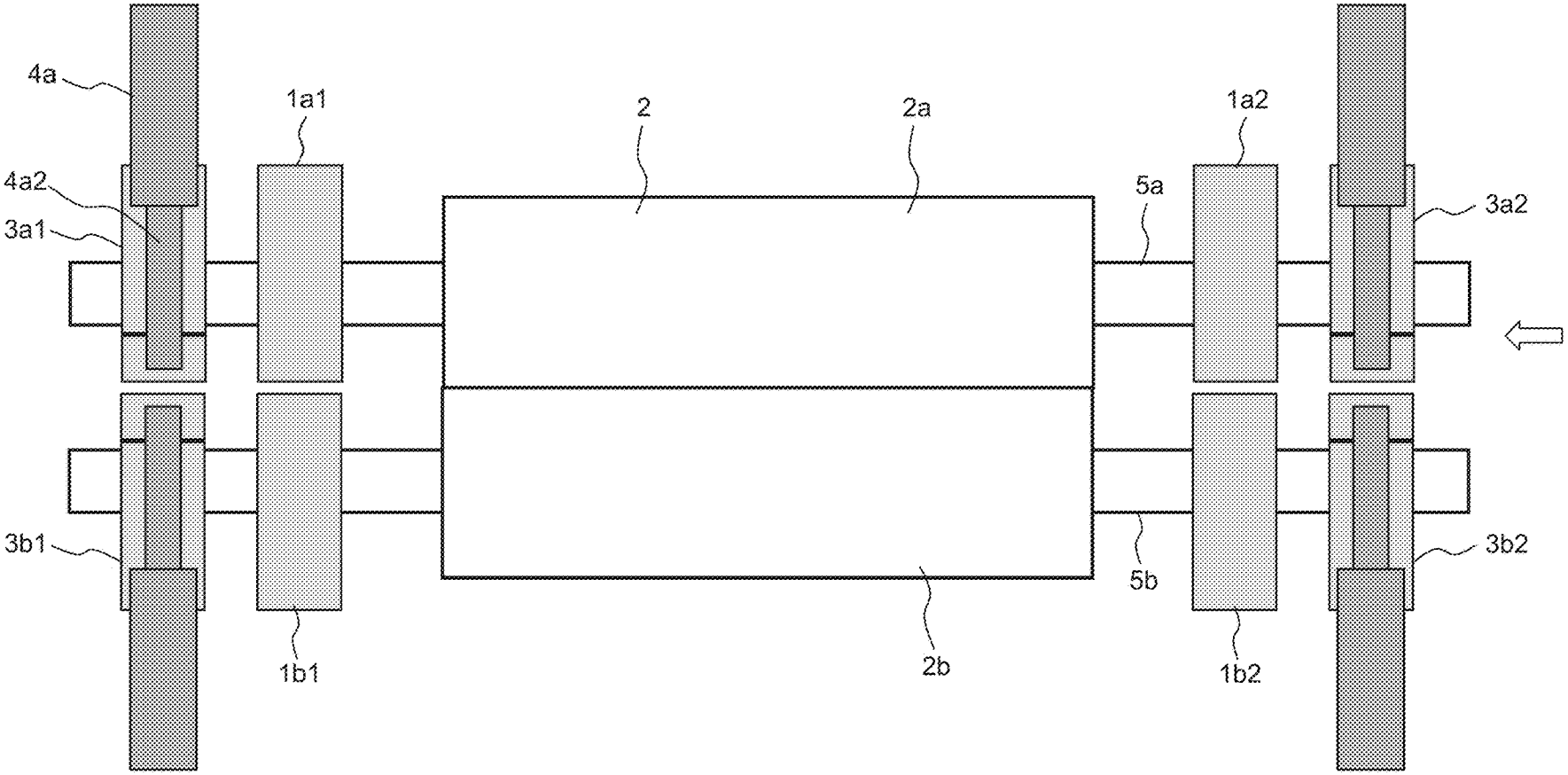
FIG. 1 is a front view showing an overall configuration of a roll press machine according to an embodiment of the present invention.

Hereinafter, a roll press machine according to the present invention will be described based on the illustrated embodiment. In the drawings, the same reference numerals are used for the same components.

Embodiment

Figure 2:
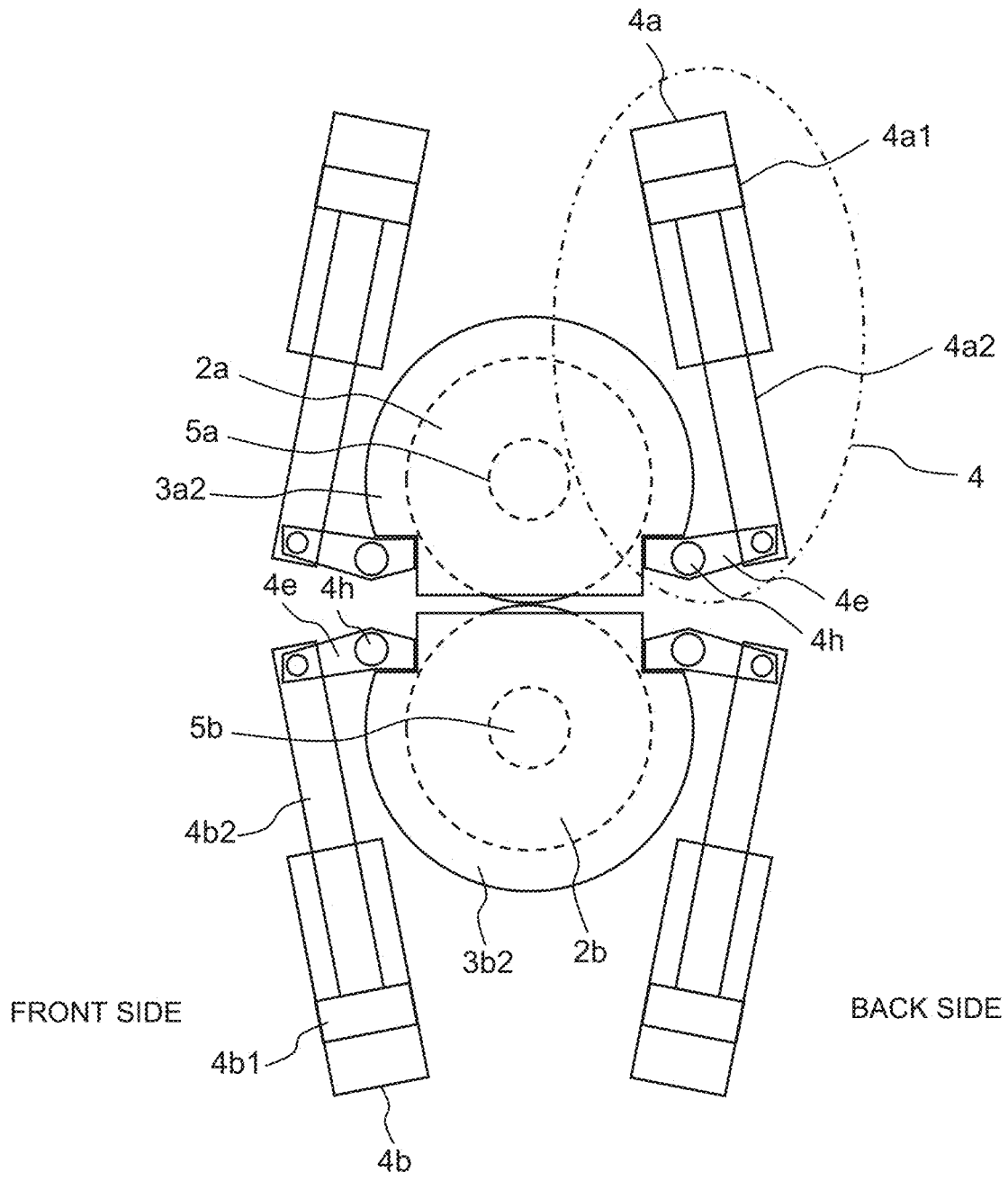
FIG. 2 is a right side view of FIG. 1 when viewed from an arrow direction (right direction)

FIG. 1 is a front view illustrating an overall configuration of a roll press machine according to an embodiment of the present invention. FIG. 2 is a right side view of FIG. 1 when viewed from an arrow direction (right direction). The roll press machine according to the present embodiment illustrated in FIGS. 1 and 2 is mainly used when a thin film material such as an electrode material of a secondary battery is subjected to compression processing.

As illustrated in FIGS. 1 and 2, the roll press machine in the present embodiment is schematically configured to include a pair of upper and lower press rolls 2 including an upper roll 2*a* and a lower roll 2*b* that rotate at a predetermined speed and has both ends of which are supported by upper main bearings 1*a*1 and 1*a*2 and lower main bearings 1*b*1 and 1*b*2, upper bending bearings 3*a*1 and 3*a*2 and lower bending bearings 3*b*1 and 3*b*2 disposed outside the upper and lower main bearings 1*a*1 and 1*a*2 and the lower main bearings 1*b*1 and 1*b*2, respectively, and a reverse operation bending mechanism 4. Two reverse operation bending mechanisms are disposed on the upper bending bearings 3*a*1 and 3*a*2 and the lower bending bearings 3*b*1 and 3*b*2, respectively, and operate with hydraulic oil.

That is, four in total, that is, two upper bending bearings 3*a*1 and 3*a*2 and two lower bending bearings 3*b*1 and 3*b*2 are disposed on the left and right sides of the upper roll 2*a* and the left and right sides of the lower roll 2*b*. Eight in total, that is, two reverse operation bending mechanisms 4 are disposed on each of the upper bending bearings 3*a*1 and 3*a*2, and two reverse operation bending mechanisms 4 are disposed on each of the lower bending bearings 3*b*1 and 3*b*2.

In the roll press machine in the present embodiment, the reverse operation bending mechanism 4 generates downward power by hydraulic pressure to apply a bending load to the upper bending bearings 3*a*1 and 3*a*2 disposed on the upper roll 2*a*, thereby moving the upper bending bearings 3*a*1 and 3*a*2. The reverse operation bending mechanism 4 generates upward power by hydraulic pressure to apply a bending load to the lower bending bearings 3*b*1 and 3*b*2 disposed on the lower roll 2*b*, thereby moving the lower bending bearings 3*b*1 and 3*b*2 downward.

As a result, the deflection occurring in the upper roll 2*a* and the lower roll 2*b* is corrected to flatten the press roll 2.

Figure 3:
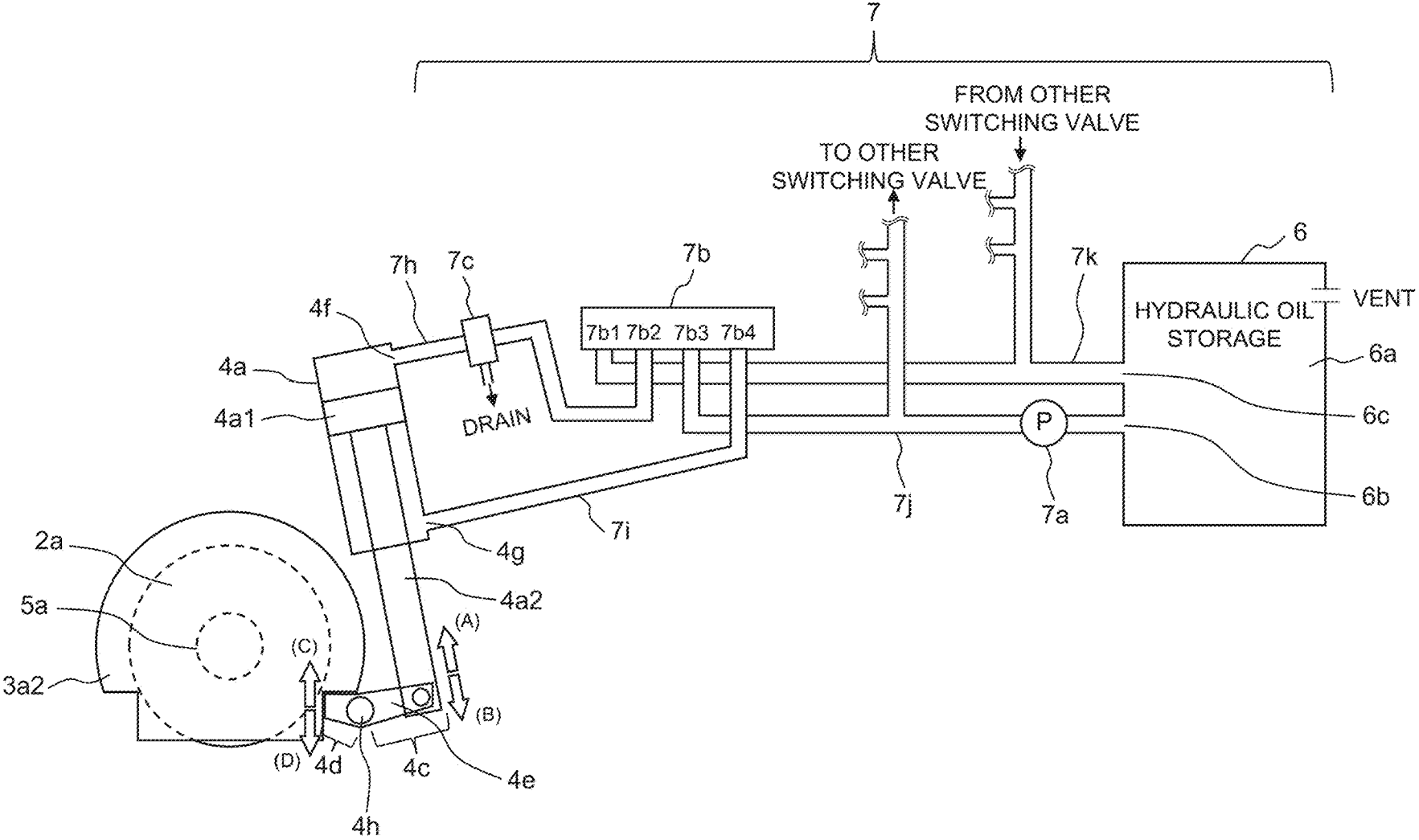
FIG. 3 is a diagram illustrating a detailed configuration of a reverse operation bending mechanism used in the roll press machine in the embodiment of the present invention.

FIG. 3 is a diagram illustrating a detailed configuration of the reverse operation bending mechanism 4 used in the roll press machine in the embodiment illustrated in FIG. 2. One reverse operation bending mechanism on the upper side among the eight disposed reverse operation bending mechanisms 4 illustrated in FIG. 3 is illustrated as a representative.

As illustrated in FIG. 3, the reverse operation bending mechanism 4 in the present embodiment is configured to include an upper cylinder unit 4*a* to which hydraulic oil 6*a* stored in a hydraulic oil storage 6 is supplied so that the upper piston 4*a*1 and the upper piston rod 4*a*2 operates to generate power, a rotational support portion (fulcrum) 4*h*, and a link portion 4*e* that is supported by the rotational support portion 4*h* and includes a power receiving portion 4*c* and a power transmission portion 4*d*. The power receiving portion 4*c* has end portions on both right and left sides, which are connected to the upper piston rod 4*a*2 of the upper cylinder unit 4*a*. The power transmission portion 4*d* has end portions that abut on the upper bending bearing 3*a*2. The inside of the upper cylinder unit 4*a* is illustrated as a transmission view for convenience of description.

When the hydraulic oil 6*a* is supplied to the inside of the upper cylinder unit 4*a*, the upper piston 4*a*1 and the upper piston rod 4*a*2 are operated by the hydraulic pressure of the hydraulic oil 6*a*, whereby power is generated via the upper piston rod 4*a*2, the power receiving portion 4*c* receives the power with the rotational support portion 4*h* as the center, and the power transmission portion 4*d* is operated in a direction opposite to a direction (the direction of the arrow (A) or (B)) in which the upper piston rod 4*a*2 operates. Thus, a see-saw operation is performed.

Thus, the upper bending bearing 3*a*2 abutting on the power transmission portion 4*d* moves upward (direction of arrow (C)) or downward (direction of arrow (D)) to generate a bending load (reverse operation bending).

As a result, the power from the upper cylinder unit 4*a* is transmitted to an upper roll shaft 5*a* as the bending load of the upper bending bearing 3*a*2, and thus deflection occurring in the upper roll 2*a* is corrected. An end portion of the power transmission portion 4*d* may be connected to the upper bending bearing 3*a*2 in a coupled manner.

In addition, in order to smoothly transmit the power from the upper cylinder unit 4*a* to the upper bending bearing 3*a*2, it is desirable that the link portion 4*e* where the end portion of the power transmission portion 4*d* abuts on the upper bending bearings 3*a*1 and 3*a*2 is formed in an inverted V shape, and the link portion 4*e* where the end portion of the power transmission portion 4*d* abuts on the lower bending bearings 3*b*1 and 3*b*2 is formed in a V shape.

Next, a mechanism for operating the reverse operation bending mechanism 4 will be described in detail with reference to FIG. 3, by taking the reverse operation bending mechanism 4 disposed on the upper roll 2*a* as an example.

As illustrated in FIG. 3, the reverse operation bending mechanism 4 includes a hydraulic oil supply mechanism 7 that applies power to the upper cylinder unit 4*a*. The upper cylinder unit 4*a* includes a first opening portion 4*f* on a side surface of an upper end portion (head side: including a vicinity portion) of the upper cylinder unit 4*a* with the upper piston 4*a*1 as a boundary, and includes a second opening portion 4*g* on a side surface of a lower end portion (upper piston rod 4*a*2 side: including a vicinity portion) of the upper cylinder unit 4*a*.

The hydraulic oil supply mechanism 7 includes the hydraulic oil storage 6 that is a tank for storing the hydraulic oil 6*a*, a hydraulic oil supply device 7*a* that is a pump for supplying the hydraulic oil 6*a* from the hydraulic oil storage 6 to the upper cylinder unit 4*a*, a switching valve 7*b* that switches a flowing direction of the hydraulic oil 6*a* by electromagnetic drive, and a pressure reducing valve 7*c* that adjusts hydraulic pressure of the hydraulic oil 6*a* supplied to the upper cylinder unit 4*a*.

Further, the hydraulic oil supply mechanism 7 includes, as pipes connecting the respective components, a first hydraulic oil flow passage 7*h* that includes a pressure reducing valve 7*c* at an intermediate position and connects the first opening portion 4*f* and a second connection port 7*b*2 provided in the switching valve 7*b*, a second hydraulic oil flow passage 7*i* that connects the second opening portion 4*g* and a fourth connection port 7*b*4 provided in the switching valve 7*b*, a hydraulic oil supply passage 7*j* that includes the hydraulic oil supply device 7*a* at an intermediate position and connects the hydraulic oil supply port 6*b* provided in the hydraulic oil storage 6 and a third connection port 7*b*3 provided in the switching valve 7*b*, and a hydraulic oil collection passage 7*k* that connects a hydraulic oil collection port 6*c* provided in the hydraulic oil storage 6 and the first connection port 7*b*1 provided in the switching valve 7*b*.

Next, switching of the flow direction of the hydraulic oil 6*a* by the switching valve 7*b* described above will be described in detail with reference to FIGS. 4A and 4B. For convenience of description, the inside is illustrated as a transmission view, similarly to the upper cylinder unit 4*a* in FIG. 3.

The first hydraulic oil flow passage 7*h*, the second hydraulic oil flow passage 7*i*, the hydraulic oil supply passage 7*j*, and the hydraulic oil collection passage 7*k* are connected to the switching valve 7*b* that drives a valve by electromagnetic drive. In a first operating state (state of FIG. 4A) selected when the bending load is applied to the pair of upper and lower upper rolls 2*a* and 2*b* by the reverse operation bending mechanism 4, the switching valve 7*b* supplies the hydraulic oil 6*a* supplied from the hydraulic oil storage 6 from the first opening portion 4*f* to the inside of the upper cylinder unit 4*a* by causing the hydraulic oil supply passage 7*j* to communicate with the first hydraulic oil flow passage 7*h* and the first opening portion 4*f*.

On the other hand, when the second opening portion 4*g* of the upper cylinder unit 4*a* communicates with the second hydraulic oil flow passage 7*i* and the hydraulic oil collection passage 7*k*, the upper piston 4*a*1 is pushed downward to discharge the hydraulic oil 6*a* from the second opening portion 4*g* to the outside of the upper cylinder unit 4*a*, and the hydraulic oil 6*a* is collected in the hydraulic oil storage 6.

In a second operating state (state of FIG. 4B) selected when the bending load applied to the pair of upper and lower rolls 2*a* and 2*b* is released by the reverse operation bending mechanism 4, the switching valve 7*b* supplies the hydraulic oil 6*a* supplied from the hydraulic oil storage 6 from the second opening portion 4*g* to the inside of the upper cylinder unit 4*a* by causing the hydraulic oil supply passage 7*j* to communicate with the second hydraulic oil flow passage 7*i* and the second opening portion 4*g*.

On the other hand, when the first opening portion 4*f* of the upper cylinder unit 4*a* communicates with the first hydraulic oil flow passage 7*h* and the hydraulic oil collection passage 7*k*, the upper piston 4*a*1 is pushed upward to discharge the hydraulic oil 6*a* from the first opening portion 4*f* to the outside of the upper cylinder unit 4*a*, and the hydraulic oil 6*a* is collected in the hydraulic oil storage 6.

Figure 4A:
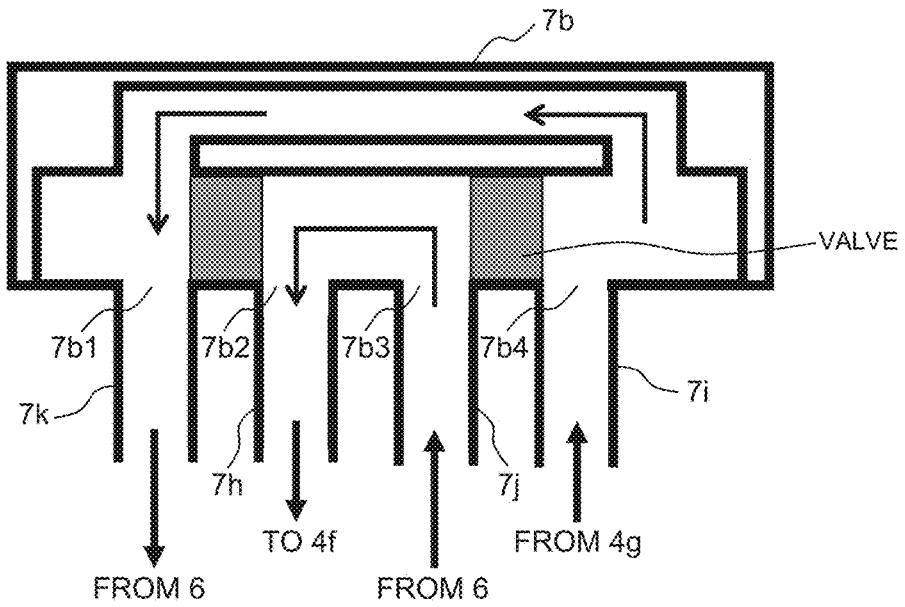
FIG. 4A is a diagram illustrating a first operating state of switching of a flowing direction of hydraulic oil by a switching valve in the reverse operation bending mechanism illustrated in FIG. 3.

When the deflection of the upper roll 2*a* and the lower roll 2*b* is corrected, the switching valve 7*b* is brought into the first operating state of FIG. 4A, so that the hydraulic oil 6*a* is supplied from the first opening portion 4*f* to the inside of the upper cylinder unit 4*a*, and the upper piston 4*a*1 is moved by the hydraulic pressure of the hydraulic oil 6*a*. At this time, the second hydraulic oil flow passage 7*i* turns into an open state, and the hydraulic oil 6*a* on the upper piston rod 4*a*2 side is discharged from the second opening portion 4*g* by the hydraulic pressure from the head side of the upper piston 4*a*1.

As a result, as illustrated in FIG. 3, deflection correction of the upper roll 2*a* is performed (deflection correction of the lower roll 2*b* is also performed in a similar manner) in a manner that the hydraulic pressure of the hydraulic oil 6*a* from the head side of the upper piston 4*a*1 causes the power receiving portion 4*c* connected to the upper piston rod 4*a*2 to generate downward power, and the link portion 4*e* performs the see-saw operation in the directions of the arrows (B) and (C) around the rotational support portion 4*h*, so that the power transmission portion 4*d* at the position facing the power receiving portion 4*c* transmits the power to the upper bending bearing 3*a*2 as the bending load.

Figure 4B:
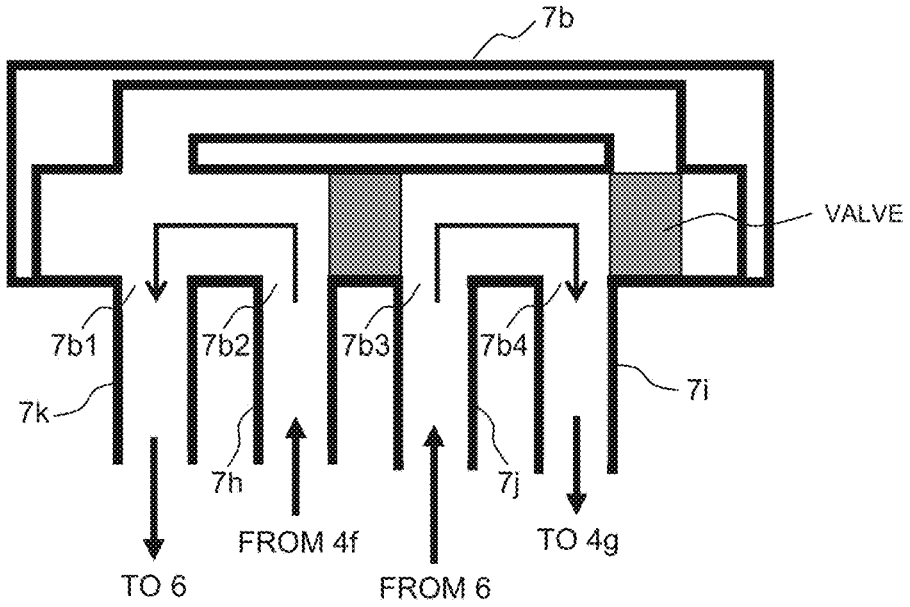
FIG. 4B is a diagram illustrating a second operating state of switching of the flow direction of the hydraulic oil by the switching valve in the reverse operation bending mechanism illustrated in FIG. 3.

When the bending load is released and the deflection correction of the upper roll 2*a* is ended, the switching valve 7*b* is brought into the second operating state of FIG. 4B, whereby the hydraulic oil 6*a* is supplied from the second opening portion 4*g* to the inside of the upper cylinder unit 4*a*, and the piston 4*a*1 is moved by the hydraulic pressure of the hydraulic oil 6*a*. At this time, the first hydraulic oil flow passage 7*h* turns into the open state, and the hydraulic oil 6*a* on the head side is discharged from the first opening portion 4*f* by the hydraulic pressure from the upper piston rod 4*a*2 side.

As a result, as illustrated in FIG. 3, the hydraulic pressure of the hydraulic oil 6*a* from the upper piston rod 4*a*2 side causes the power receiving portion 4*c* connected to the upper piston rod 4*a*2 to generate upward power, and the link portion 4*e* performs the see-saw operation in the directions of the arrows (A) and (D) around the rotational support portion 4*h*, so that the power transmission portion 4*d* at the position facing the power receiving portion 4*c* is lowered downward, and the operation of bringing the position of the upper bending bearing 3*a*2 back to the original position is performed.

It is desirable that the link portion 4*e* in the reverse operation bending mechanism 4 sets the disposition position of the rotational support portion 4*h* such that the length of the power receiving portion 4*c* is longer than the length of the power transmission portion 4*d*, and the ratio is set such that power transmission portion 4*d*:power receiving portion 4*c*=1:1 or more.

In the conventional deflection correction of the upper roll 2*a* and the lower roll 2*b*, the direction of the power output from the upper cylinder unit 4*a* by the hydraulic pressure of the hydraulic oil 6*a* is the same as the direction of the bending load applied to the roll shaft 5*a* by the upper bending bearing 3*a*2. That is, since the upper piston rod 4*a*2 and the upper bending bearing 3*a*2 are directly connected, when bending correction is performed by pulling up the upper bending bearing 3*a*2 upward in the upper roll 2*a*, it is necessary to supply the hydraulic oil 6*a* to the upper piston rod 4*a*2 side inside the upper cylinder unit 4*a* and move the upper piston 4*a*1 upward.

Therefore, when it is necessary to perform pressing at higher linear pressure than in the related art, it is necessary to increase the bending load. As a result, it is necessary to increase the size of the upper cylinder unit 4*a* in the upward direction, and the machine main body in which the upper cylinder unit 4*a* is disposed also needs to be increased in size, which results in an increase in cost.

However, in the present embodiment, the link portion 4*e* is disposed between the upper piston rod 4*a*2 and the upper bending bearing 3*a*2, the hydraulic oil 6*a* is supplied to the head side of the upper piston 4*a*1 inside the upper cylinder unit 4*a* to move the upper piston 4*a*1 downward, and the direction in which the power of the upper cylinder unit 4*a* is output is set to be opposite to the direction in which the upper bending bearing 3*a*2 transmits the bending load to the upper roll shaft 5*a* (reverse operation bending). Thus, it is possible to effectively utilize the downward space on the upper piston rod 4a2 side of the upper piston 4a1 and to operate the upper piston rod 4a2 in the downward direction, so that it is not necessary to increase the size of the upper cylinder unit 4a in the upward direction.

Figure 5:
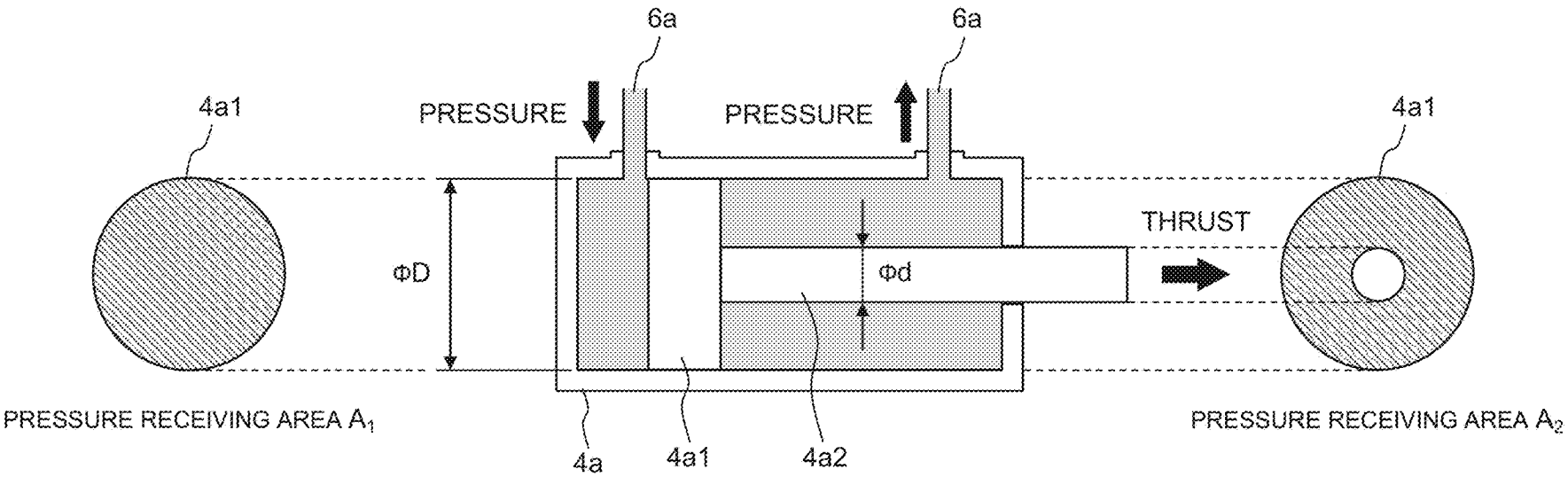
FIG. 5 is a diagram illustrating a pressure receiving area received by a piston from the hydraulic oil in the reverse operation bending mechanism illustrated in FIG. 3 in comparison with a pressure receiving area received by a conventional piston from the hydraulic oil.

As illustrated in FIG. 5, since the hydraulic oil 6a is conventionally supplied to the upper piston rod 4a2 side of the upper piston 4a1, the pressure receiving area $A_2$ received by the upper piston 4a1 from the hydraulic oil 6a can be received only by the area (about 70%) excluding the portion corresponding to the cross-sectional area perpendicular to the longitudinal direction of the upper piston rod 4a2.

On the other hand, in the roll press machine in the present embodiment, by supplying the hydraulic oil 6a to the head side of the upper piston 4a1, it is possible to set the entire head-side surface (100%) of the upper piston 4a1 as the pressure receiving area $A_1$ from the hydraulic oil 6a. Therefore, when compared with the pressure of the same hydraulic oil 6a, the output generated by the upper cylinder unit 4a is large, and it is not necessary to increase the cylinder size.

For the above reasons, in the roll press machine in the present embodiment, it is not necessary to increase the size of the machine main body in which the upper cylinder unit 4a is disposed, and it is possible to suppress the cost of the entirety of the machine.

In the reverse operation bending mechanism 4 disposed on the lower roll 2b, the vertical positional relationship (for example, the first opening portion 4f is provided on the side surface of the lower end portion of the lower cylinder unit 4b, and the second opening portion 4g is provided on the side surface of the upper end portion thereof) of the constituent equipment, the transmission direction of the power and the bending load, the movement direction of the lower bending bearings 3b1 and 3b2, and the like are opposite to those of the upper roll 2a, but the other structures and operations are the same as those of the reverse operation bending mechanism 4 disposed on the upper roll 2a.

Figure 6:
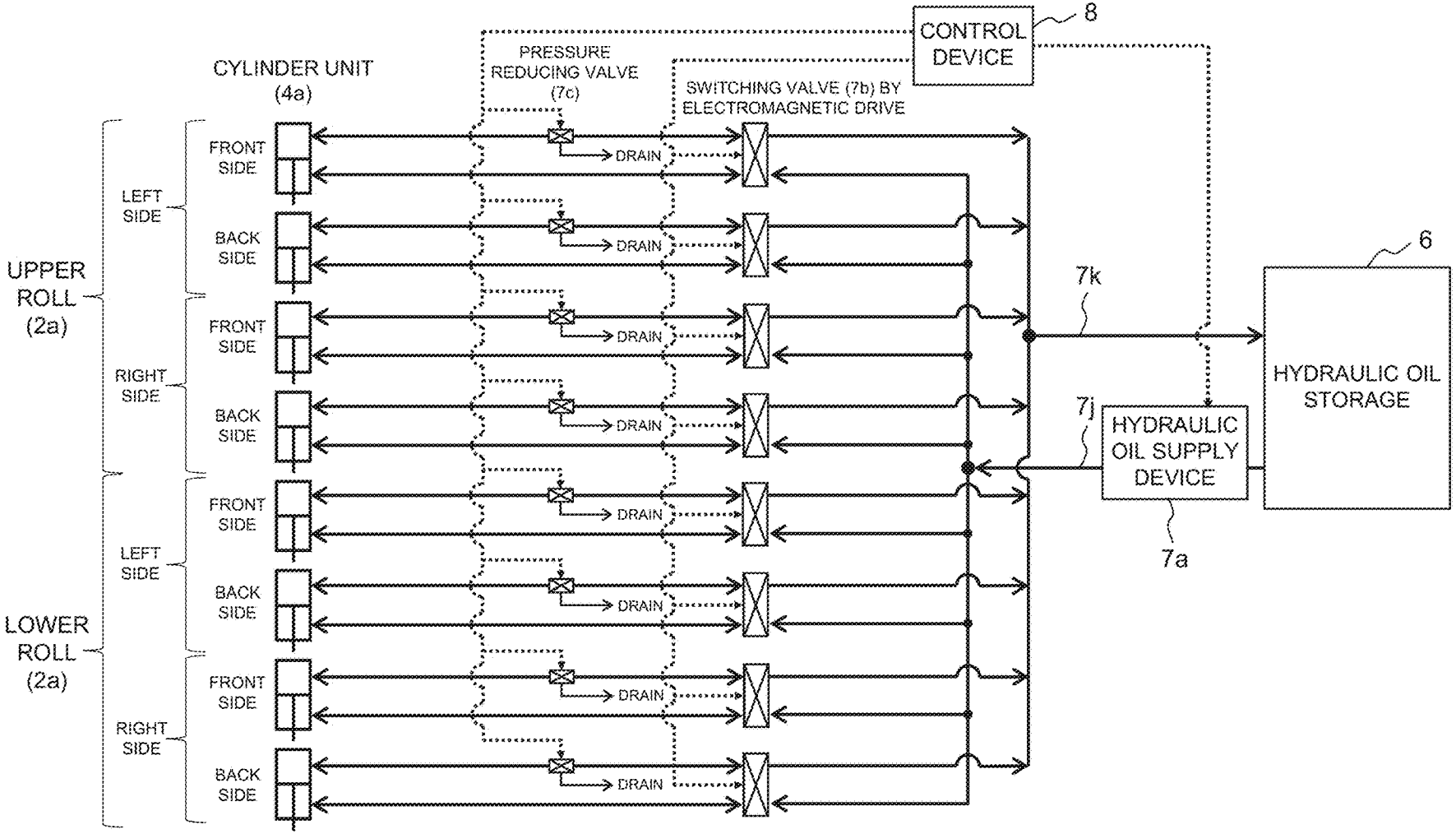
FIG. 6 is a diagram illustrating a system of a hydraulic oil supply mechanism for operating the reverse operation bending mechanism illustrated in FIG. 3.
Figure 7:
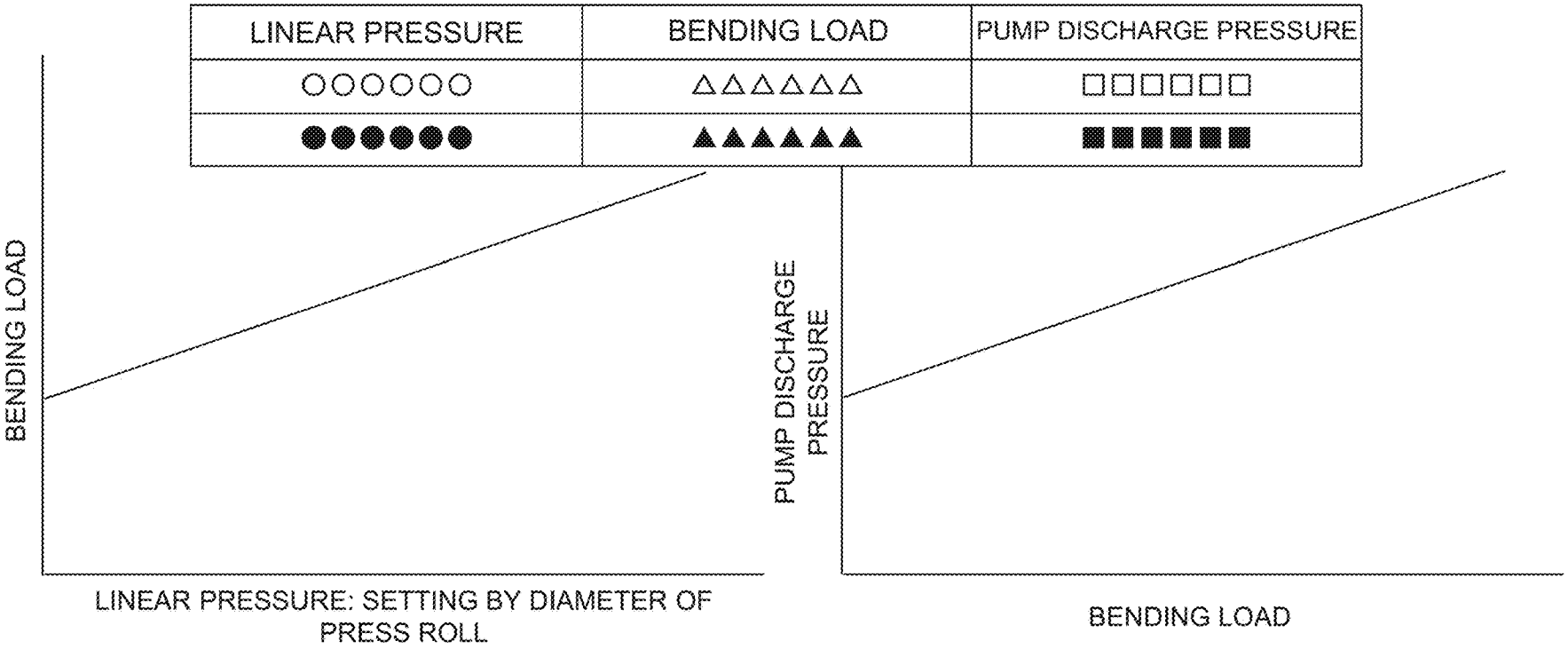
FIG. 7 is a diagram for explaining setting of discharge pressure of a hydraulic oil supply device used in the system of the hydraulic oil supply mechanism illustrated in FIG. 6.

Next, FIG. 6 illustrates a system of the hydraulic oil supply mechanism 7 for operating the reverse operation bending mechanism 4, and FIG. 7 illustrates setting of the discharge pressure of the hydraulic oil supply device 7a used in the system of the hydraulic oil supply mechanism 7.

As illustrated in FIG. 6, the hydraulic oil storage 6 stores a predetermined amount of the hydraulic oil 6a, and supplies and collects the hydraulic oil 6a also to a mechanism that operates a main bearing (not illustrated) or the like, in addition to the hydraulic oil supply mechanism 7. As a result, since the storage level of the hydraulic oil 6a varies, a vent is provided at the upper portion to adjust the internal pressure.

The first hydraulic oil flow passage 7h and the second hydraulic oil flow passage 7i between the upper cylinder unit 4a and the switching valve 7b are connected to the first opening portion 4f and the second opening portion 4g of the upper cylinder unit 4a, respectively, and the direction in which the hydraulic oil 6a flows is switched by the switching valve 7b. When the hydraulic oil 6a is supplied from the first opening portion 4f or the second opening portion 4g to the inside of the upper cylinder unit 4a, the hydraulic oil 6a is supplied from the hydraulic oil storage 6 by driving a hydraulic oil supply device (pump) 7a having predetermined discharge pressure.

As illustrated in FIG. 7, the hydraulic oil supply device 7a sets the bending load in accordance with the linear pressure set by the diameter of the press roll 2 including the upper roll 2a and the lower roll 2b, sets the discharge pressure of the hydraulic oil supply device 7a in accordance with the bending load, and sets the supply amount per unit time of the hydraulic oil 6a supplied to the upper and lower cylinder units corresponding to the upper bending bearings 3a1 and 3a2 and the lower bending bearings 3b1 and 3b2 disposed on the upper roll 2a and the lower roll 2b.

In addition, the roll press machine in the present embodiment includes a control device 8 (see FIG. 6) that controls the switching valve 7b and the pressure reducing valve 7c. The control device 8 brings the switching valve 7b into the first operating state illustrated in FIG. 4A when processing by the roll press machine is started, and brings the switching valve 7b into the second operating state illustrated in FIG. 4B when the processing by the roll press machine is ended.

By bringing the switching valve 7b into the first operating state illustrated in FIG. 4A, the hydraulic oil 6a is supplied from the first opening portion 4f to the inside of the upper cylinder unit 4a via the first hydraulic oil flow passage 7h. At this time, the opening degree of the pressure reducing valve 7c is set in accordance with the condition of the bending load.

That is, since the hydraulic oil supply device 7a normally supplies the hydraulic oil 6a by continuously operating at constant discharge pressure (21 MPa), the hydraulic oil 6a is supplied to each switching valve 7b at the same supply amount after branching after supply. The supply pressure per unit time of the hydraulic oil 6a is individually adjusted by the opening degree of the pressure reducing valve 7c, in accordance with the deflection amounts of the end portion of the upper roll 2a and the end portion of the lower roll 2b to set the bending load.

As a result, it is possible to freely adjust bending forces of the upper bending bearings 3a1 and 3a2 and the lower bending bearings 3b1 and 3b2. The hydraulic oil 6a drained by the pressure reducing valve 7c is collected in the hydraulic oil storage 6.

As described above, in each reverse operation bending mechanism 4, the operation of the reverse operation bending mechanism 4 is realized in a manner that the hydraulic oil 6a is supplied from the hydraulic oil storage 6 by the hydraulic oil supply device 7a, and is supplied with switching the flow passage of the hydraulic oil 6a to the first opening portion 4f or the second opening portion 4g by the switching valve 7b, and the hydraulic oil 6a is circulated by the flow passage for collecting the hydraulic oil 6a from the second opening portion 4g or the first opening portion 4f and bringing the hydraulic oil 6a back to the hydraulic oil storage 6.

With such a roll press machine in the present embodiment, even if the roll press machine includes the bending mechanism that corrects the deflection of the upper roll 2a and the lower roll 2b, the machine does not increase in size and does not lead to an increase in cost.

The present invention is not limited to the above embodiment, and various modification examples may be provided. For example, the above embodiments are described in detail in order to explain the present invention in an easy-to-understand manner, and the above embodiments are not necessarily limited to a case including all the described configurations. Further, some components in one embodiment can be replaced with the components in another embodiment, and the configuration of another embodiment can be added to the configuration of one embodiment. Regarding some components in the embodiments, other components can be added, deleted, and replaced.

What is claimed is:

1. A roll press machine that compression-processes a thin film material, the roll press machine comprising:

a pair of upper and lower press rolls each including an upper roll and a lower roll that are supported by a main bearing at both ends and rotate at a predetermined speed;

upper and lower bending bearings that are disposed outside each of the main bearings and correct deflection of the press rolls by receiving a bending load; and two upper reverse operation bending mechanisms provided in the upper roll, and two lower reverse operation bending mechanisms provided in the lower roll, the upper reverse operation bending mechanisms and the lower reverse operation bending mechanisms being installed in the upper and lower bending bearings, respectively, wherein each of the upper and lower reverse operation bending mechanisms operates with hydraulic oil, wherein each of the upper reverse operation bending mechanisms includes an upper cylinder unit, the upper cylinder unit having an upper piston and an upper piston rod, each of the lower reverse operation bending mechanisms include a lower cylinder unit, the lower cylinder unit having a lower piston and a lower piston rod, each of the upper reverse operation bending mechanisms includes a rotational support portion, each of the lower reverse operation bending mechanisms include a rotational support portion, each of the upper reverse operation bending mechanisms includes a link portion configured by a power receiving portion that is supported by the rotational support portion, the link portion having ends connected to the upper piston rod on both left and right sides of the upper roll, and a power transmission portion having ends abutting on the upper bending bearing, each of the lower reverse operation bending mechanism include a link portion configured by a power receiving portion that is supported by the rotational support portion, the link portion having ends connected to the lower piston rod on both left and right sides of the lower roll, and a power transmission portion having ends abutting on the lower bending bearing, the upper and lower pistons and the upper and lower piston rods are operated by a hydraulic pressure of the hydraulic oil to generate power, so that the power receiving portion and the power transmission portion are operated in a see-saw manner to move upward or downward the upper and lower bending bearings abutting on the power transmission unit, the deflection occurring in the upper roll and the lower roll is corrected in a manner that the bending load that moves upward the upper bending bearing disposed on the upper roll is applied by causing the upper reverse operation bending mechanism to generate downward power by the hydraulic pressure of the hydraulic oil, and the bending load that moves downward the lower bending bearing disposed on the lower roll is applied by causing the lower reverse operation bending mechanism to generate upward power by the hydraulic pressure of the hydraulic oil, the link portion in which an end portion of the power transmission portion abuts on the upper bending bearing is formed in a V shape, and the link portion in which the end portion of the power transmission portion abuts on the lower bending bearing is formed in an inverted V shape.

2. The roll press machine according to claim 1, wherein the upper cylinder unit includes a first opening portion on a side surface of an upper end portion of the upper cylinder unit, and a second opening portion on a side surface of a lower end portion of the upper cylinder unit, the upper reverse operation bending mechanism includes a hydraulic oil supply mechanism to which the hydraulic oil is supplied through the first opening portion and the second opening portion, the hydraulic oil supply mechanism includes a hydraulic oil storage that stores the hydraulic oil, a hydraulic oil supply device that supplies the hydraulic oil to the upper cylinder unit, a switching valve that switches a flowing direction of the hydraulic oil by electromagnetic drive, a pressure reducing valve that adjusts the hydraulic pressure of the hydraulic oil supplied to the upper cylinder unit, a first hydraulic oil flow passage that includes the pressure reducing valve at an intermediate position and connects the first opening portion and a second connection port provided in the switching valve, a second hydraulic oil flow passage that connects the second opening portion and a fourth connection port provided in the switching valve, a hydraulic oil supply passage that includes the hydraulic oil supply device at an intermediate position and connects a hydraulic oil supply port provided in the hydraulic oil storage and a third connection port provided in the switching valve, and a hydraulic oil collection passage that connects a hydraulic oil collection port provided in the hydraulic oil storage and a first connection port provided in the switching valve, in a first operating state selected when the bending load is applied to the upper roll by the upper reverse operation bending mechanism, the switching valve supplies the hydraulic oil supplied from the hydraulic oil storage to an inside of the upper cylinder unit from the first opening portion by causing the hydraulic oil supply passage to communicate with the first hydraulic oil flow passage and the first opening portion, and in a second operating state selected when the bending load of the upper roll is released by the upper reverse operation bending mechanism, the hydraulic oil supplied from the hydraulic oil storage is supplied from the second opening portion to the inside of the upper cylinder unit by causing the hydraulic oil supply passage to communicate with the second hydraulic oil flow passage and the second opening portion.

3. The roll press machine according to claim 2, wherein in the first operating state, when the upper and lower pistons are pushed downward or upward by causing the second opening portions of the upper and lower cylinder units to communicate with the second hydraulic oil flow passage and the hydraulic oil collection passage, the hydraulic oil is discharged from the second opening portions to an outside of the upper and lower cylinder units, and the hydraulic oil is collected in the hydraulic oil storage, and in the second operating state, when the upper and lower pistons are pushed downward or upward by causing the first opening portions of the upper and lower cylinder units to communicate with the first hydraulic oil flow passage and the hydraulic oil collection passage, the hydraulic oil is discharged from the first opening portions to the outside of the upper and lower cylinder units, and the hydraulic oil is collected in the hydraulic oil storage.

4. The roll press machine according to claim 3, wherein when the switching valve is brought into the first operating state, the power is generated so that the link portion performs a see-saw operation and transmits the power as the bending load to the upper and lower bending bearings, and when the switching valve is brought into the second operating state, the link portion performs the see-saw operation so that positions of the upper and lower bending bearings are brought back to original positions.

5. The roll press machine according to claim 4, wherein when the deflection of the upper roll and the lower roll is corrected, the switching valve is brought into the first operating state to supply the hydraulic oil from the first opening portion to the inside of the upper and lower cylinder units, and the upper and lower pistons are moved by the hydraulic pressure of the hydraulic oil, at this time, the deflection of the upper roll and the lower roll is corrected in a manner that upward or downward power is generated in the power receiving portion connected to the upper and lower piston rods by the hydraulic pressure of the hydraulic oil from head sides of the upper and lower pistons, the link portion performs a see-saw operation around the rotational support portion, and the power transmission portion transmits the power to the upper and lower bending bearings as the bending load, when applying the bending load is released and deflection correction of the upper roll and the lower roll is ended, the switching valve is brought into the second operating state to supply the hydraulic oil from the second opening portion to the inside of the upper and lower cylinder units, and the upper and lower pistons are moved by the hydraulic pressure of the hydraulic oil, and at this time, an operation of bringing the positions of the upper and lower bending bearings back to the original positions is performed in a manner that upward or downward power is generated in the power receiving portion connected to the upper and lower piston rods by the hydraulic pressure of the hydraulic oil from the upper and lower piston rod sides, the link portion performs the see-saw operation around the rotational support portion, and the power transmission portion is lowered downward or rises upward.

6. The roll press machine according to claim 2, wherein when the hydraulic oil is supplied from the first opening portion to the inside of the upper and lower cylinder units, the hydraulic oil is supplied from the hydraulic oil storage by driving the hydraulic oil supply device having predetermined discharge pressure.

7. The roll press machine according to claim 6, wherein the hydraulic oil supply device sets the bending load in accordance with linear pressure set by a diameter of the press roll, sets the discharge pressure of the hydraulic oil supply device in accordance with the bending load, and sets a supply amount per unit time of the hydraulic oil supplied to the upper and lower cylinder units corresponding to the upper and lower bending bearings arranged on the upper roll and the lower roll.

8. The roll press machine according to claim 2, further comprising:

a control device that controls the switching valve and the pressure reducing valve, wherein the control device brings the switching valve into the first operating state when processing by the roll press machine is started, brings the switching valve into the second operating state when the processing by the roll press machine is ended, and sets an opening degree of the pressure reducing valve in accordance with a condition of the bending load in the first operating state.

9. The roll press machine according to claim 8, wherein the bending load is set by individually adjusting a supply amount per unit time of the hydraulic oil by an opening degree of the pressure reducing valve in accordance with a deflection amount of an end portion of the upper roll and an end portion of the lower roll.

10. The roll press machine according to claim 1, wherein the lower cylinder unit includes a first opening portion on a side surface of a lower end portion of the lower cylinder unit, and a second opening portion on a side surface of an upper end portion of the lower cylinder unit, the lower reverse operation bending mechanism includes a hydraulic oil supply mechanism to which the hydraulic oil is supplied through the first opening portion and the second opening portion, the hydraulic oil supply mechanism includes a hydraulic oil storage that stores the hydraulic oil, a hydraulic oil supply device that supplies the hydraulic oil to the lower cylinder unit, a switching valve that switches a flowing direction of the hydraulic oil by electromagnetic drive, and a pressure reducing valve that adjusts the hydraulic pressure of the hydraulic oil supplied to the lower cylinder unit, a first hydraulic oil flow passage that includes the pressure reducing valve at an intermediate position and connects the first opening portion and a second connection port provided in the switching valve, a second hydraulic oil flow passage that connects the second opening portion and a fourth connection port provided in the switching valve, a hydraulic oil supply passage that includes the hydraulic oil supply device at an intermediate position and connects a hydraulic oil supply port provided in the hydraulic oil storage and a third connection port provided in the switching valve, and a hydraulic oil collection passage that connects a hydraulic oil collection port provided in the hydraulic oil storage and a first connection port provided in the switching valve, in a first operating state selected when the bending load is applied to the lower roll by the lower reverse operation bending mechanism, the switching valve supplies the hydraulic oil supplied from the hydraulic oil storage to an inside of the lower cylinder unit from the first opening portion by causing the hydraulic oil supply passage to communicate with the first hydraulic oil flow passage and the first opening portion, and in a second operating state selected when the bending load of the lower roll is released by the lower reverse operation bending mechanism, the hydraulic oil supplied from the hydraulic oil storage is supplied from the second opening portion to the inside of the lower cylinder unit by causing the hydraulic oil supply passage to communicate with the second hydraulic oil flow passage and the second opening portion.

11. The roll press machine according to claim 10, wherein in the first operating state, when the upper and lower pistons are pushed downward or upward by causing the second opening portions of the upper and lower cylinder units to communicate with the second hydraulic oil flow passage and the hydraulic oil collection passage, the hydraulic oil is discharged from the second opening portions to an outside of the upper and lower cylinder units, and the hydraulic oil is collected in the hydraulic oil storage, and in the second operating state, when the upper and lower pistons are pushed downward or upward by causing the first opening portions of the upper and lower cylinder units to communicate with the first hydraulic oil flow passage and the hydraulic oil collection passage, the hydraulic oil is discharged from the first opening portions to the outside of the upper and lower cylinder units, and the hydraulic oil is collected in the hydraulic oil storage.

12. The roll press machine according to claim 10, wherein when the hydraulic oil is supplied from the first opening portion to the inside of the upper and lower cylinder units, the hydraulic oil is supplied from the hydraulic oil storage by driving the hydraulic oil supply device having predetermined discharge pressure.

13. The roll press machine according to claim 10, further comprising:

a control device that controls the switching valve and the pressure reducing valve, wherein the control device brings the switching valve into the first operating state when processing by the roll press machine is started, brings the switching valve into the second operating state when the processing by the roll press machine is ended, and sets an opening degree of the pressure reducing valve in accordance with a condition of the bending load in the first operating state.

14. The roll press machine according to claim 1, wherein the link portion sets a disposition position of the rotational support portion such that a length of the power receiving portion is equal to or longer than a length of the power transmission portion.

* * * * *